United States Patent [19]

Cockeram

[11] 4,414,075

[45] Nov. 8, 1983

[54] APPARATUS FOR AND A METHOD OF SELECTIVE PLATING OF COMPONENTS INCLUDING STRIP COMPONENTS

[76] Inventor: John M. Cockeram, 3 Church Rd., Spratton, Northampton, England

[21] Appl. No.: 333,692

[22] Filed: Dec. 23, 1981

[30] Foreign Application Priority Data

Dec. 23, 1980 [GB] United Kingdom ..... 8041267
Sep. 17, 1981 [GB] United Kingdom ..... 8128196

[51] Int. Cl.[3] ..... C25D 5/02; C25D 5/08; C25D 17/00

[52] U.S. Cl. ..... 204/15; 204/206; 204/224 R

[58] Field of Search ..... 204/15, 206, 224 R

[56] References Cited

U.S. PATENT DOCUMENTS 3,974,056 8/1976 Jogwick ..... 204/15
4,036,725 7/1977 Allen ..... 204/206

*Primary Examiner*—T. M. Tufariello
*Attorney, Agent, or Firm*—Spencer, Kaye & Frank

[57] ABSTRACT

An apparatus for use in selective plating a component, which apparatus comprises an electroplating zone, a series of movable selective plating heads in an endless chain configuration, wherein each plating head comprises an electrolyte opening, means for indexing the plating head to a component, means for engaging the component so as to expose an area to be selectively plated to electrolyte, means for releasably sealing the rear of the component in the region of the area to be plated, means for fastening the sealing means prior to the entry of the plating head into the electroplating zone and means for releasing the sealing means after the plating head leaves the electroplating zone, resilient or slidable couplings provided between the plating heads and means provided in the electroplating zone for supplying electrolyte to the area to be selectively plated, as well as a method of selective plating a component, which method comprises: providing an electroplating zone and moving through the electroplating zone a series of movable selective plating heads in an endless chain configuration, each plating head comprising an electrolyte opening, indexing a plating head to the component, engaging the component so as to expose an area to be selective plated, sealing the rear of the component in the region of the area to be plated, prior to the entry of the plating head into the electroplating zone, releasing the rear of the component after the plating head leaves the electroplating zone, providing resilient or slidable couplings between the plating heads and supplying, in the electroplating zone, electrolyte to the area to be selectively plated.

10 Claims, 6 Drawing Figures

APPARATUS FOR AND A METHOD OF SELECTIVE PLATING OF COMPONENTS INCLUDING STRIP COMPONENTS

BACKGROUND OF THE INVENTION

The present invention relates to an apparatus for and a method of selective plating of components, including strip components.

In prior proposals for selective plating of strip components with extreme accuracy, indexing of the strip component has been effected by stopping the forward movement of the strips, locating a portion of the strip in relation to a plating mask and then moving the strip forward. However, engineers are not enamoured with stop/start machines, because they tend to be unreliable and subject to wear.

OBJECT OF THE INVENTION

It is an object of the present invention to provide an apparatus for, and a method of, selective plating components, including strip components, with extreme accuracy.

SUMMARY OF THE INVENTION

According to a first aspect of the present invention, there is provided an apparatus for use in selective plating a component, which apparatus comprises an electroplating zone, a series of movable selective plating heads in an endless chain configuration, wherein each plating head comprises an electrolyte opening, means for indexing the plating head to a component, means for engaging the component so as to expose an area to be selectively plated to electrolyte, means for releasably sealing the rear of the component in the region of the area to be plated, means for fastening the sealing means prior to the entry of the plating head into the electroplating zone and means for releasing the sealing means after the plating head leaves the electroplating zone, resilient or slidable couplings provided between the plating heads and means provided in the electroplating zone for supplying electrolyte to the area to be selectively plated. Generally, in use of the apparatus for plating a strip component, drive means are provided for the strip and plating heads will be pulled around by the strip. With very delicate strips, or where it is desired to plate a number of discrete components or short strip components, the plating heads may be pulled round by secondary drive means. Feeding means may be provided for feeding a series of discrete components or short strip components to successive plating heads.

According to a second aspect of the present invention there is provided a method of selective plating a component, which method comprises: providing an electroplating zone and moving through the electroplating zone a series of movable selective plating heads in an endless chain configuration, each plating head comprising an electrolyte opening, indexing a plating head to the component, engaging the component so as to expose an area to be selective plated, sealing the rear of the component in the region of the area to be plated, prior to the entry of the plating head into the electroplating zone, releasing the rear of the component after the plating head leaves the electroplating zone, providing resilient or slidable couplings between the plating heads and supplying, in the electroplating zone, electrolyte to the area to be selectively plated.

The present invention can be used to plate with any electrolyte suitable for use in selective plating. Gold, silver and nickel can, for example, be plated. Typically, a strip of components, such as lead-frames, is electroplated with, for example, silver. With lead frames, it may be preferable for the frames to be indexed to the plating heads by means of slots therein rather than the holes therebetween, to give easier location therein of the indexing means.

It is preferred that the sealing means comprises a hinged member having a pressure pad to abut the strip, with spring means normally urging the hinged member open, with a roller or cam closing the hinged member and being retained closed across the plating zone by means of a releasable clamp.

Advantageously, the means for supplying electrolyte to the area to be plated comprises an elongate slot jet which locates in a corresponding slot formed in a lower part of each plating head.

In a preferred embodiment of the invention, the means for engaging the strip so as to expose, in use, the area to be selectively plated to electrolyte comprises a masking member insertable between track lines of the plating head and having one or more plating openings formed therein.

BRIEF DESCRIPTION OF THE DRAWINGS

Other objects and advantages of the present invention will become apparent from the following description made with reference to the accompanying drawings, in which.

DESCRIPTION OF THE PREFERRED EMBODIMENTS

Figure 1:
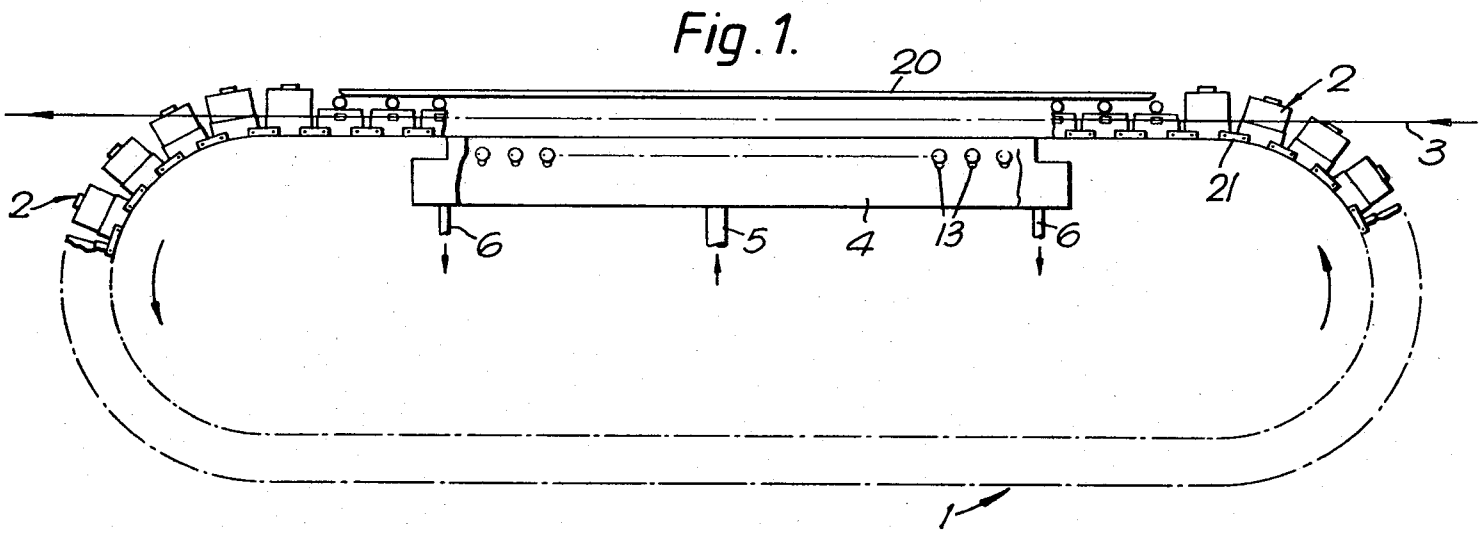
FIG. 1 shows a diagrammatic side view of a first embodiment of the present invention.

Referring now to the drawings, the apparatus shown in FIG. 1 comprises a track 1 comprising individual track links 2 passing around carrier pulleys (not shown). The carrier pulleys are non-driven, that is free-wheeling, with the strip to be plated being driven elsewhere in the plant. However, the rear carrier pulley could be driven. The track links 2 are loosely linked together to assist in correct spacing when approaching the component strips 3 to be plated. The track links 2 pass over an elongate plating tank 4 having the usual solution feed 5 and drains 6.

Figure 3:
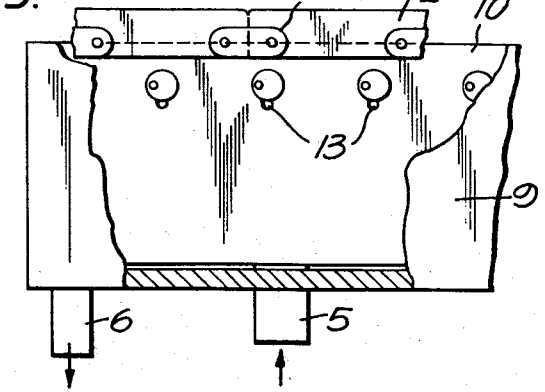
FIG. 3 shows a partial diagrammatic side view of the plating zone of the apparatus of FIG. 1.
Figure 2:
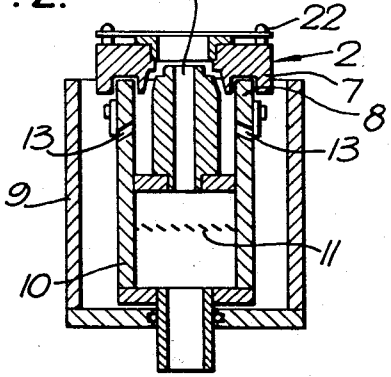
FIG. 2 shows a sectional view of a plating tank of the apparatus of FIG. 1.

Referring to FIGS. 2 and 3, the track links 2 are provided with track lines 7 to slide on tracks 8 of the plating tank 4. The tank 4 comprises an outer tank 9 and an inner tank 10 with an "O"-ring seal therebetween. An anode 11 is typically mounted in the inner tank 10 below an elongate slot jet 12 or in the area of the jet orifice.

The elongate slot jet 12 locates in a corresponding slot in the underside of each track link 2, defined by the track lines 7. In order to obtain a high electrolyte agitation rate, the width of the jet 12 is typically approximately twice the distance between the jet 12 and the sides of the slot in which it locates. In the sides of the inner tank 10 are provided adjustable weirs 13. The pressure of electrolyte is normally adjusted so that sufficient agitation thereof occurs but without unnecessary flow through the weirs 13. Leakage of electrolyte occurs between the track lines 7 and the tracks 8 mounted on or constituting the top of the tank 4, so that the links 2 "aquaplane" at reduced friction.

Figure 4:
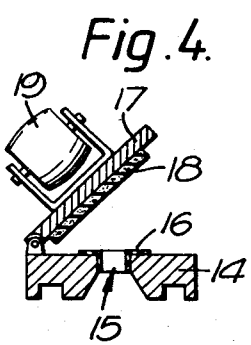
FIG. 4 shows a sectional view of a track link of the apparatus of FIG. 1.

Referring now to FIG. 4, it will be seen that each track link 1 comprises a rigid member 14 provided with one or more plating openings 15 having a seal 16, generally of rubber, thereabout. A lid 17 is hinged to the main member and the underside of the lid 17 is provided with a pressure pad 18, normally made of foam rubber. On the top of the lid may be provided a roller 19, normally made of nylon. The lid 17 is spring loaded so as to open automatically at a suitable position; a releasable clamp retains the lid in the closed position during plating.

Above the plating tank 4 is provided a member 20 on which the rollers 19 can bear to maintain even pressure on the tracks 8.

Between the track links 2, a means is provided whereby the spacing between the track links can adjust. In the embodiment shown in FIG. 1, a bar 21 is fitted between two adjacent track links 2 in such a way that the two links can move relative to each other by, for example, one end or both ends of the bar 21 being slidably mounted on the respective track link.

When an individual track link approaches the strip to be selectively plated, locating pins 22 pass through the strip to the same. For ease of operation, it is preferred that the locating pins 22 locate into slots, but they can locate in holes if necessary. As the track link 2 approaches the plating tank 4, the lid 17 is closed by a cam or roller, thereby gripping the strip. Because the strip is pulling the track link, the strip is reliably located in the track link 2. The track link 2 then passes the plating tank 4, where selective plating occurs. The pressure of electrolyte should be adjusted so that there is just sufficient agitation. This would be a pressure considerably lower than the typical pressure of about 10 to 15 psi generally used in a "Carousel" type plating machine. On completion of the pass through the plating tank 4, the lid 17 of the track link is automatically opened and the strip 3 can continue straight on and the track link pass around the carrier pulleys.

Figure 5:
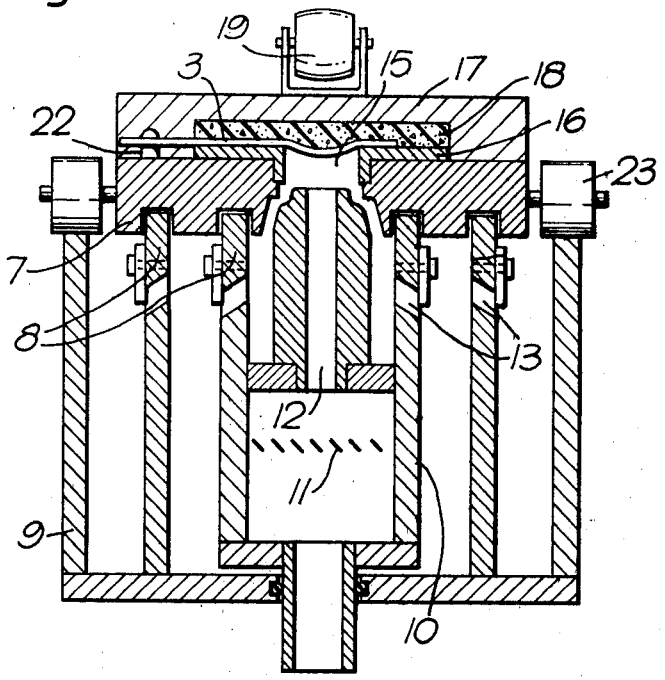
FIG. 5 shows a partial sectional view of a second embodiment of the present invention.
Figure 6:
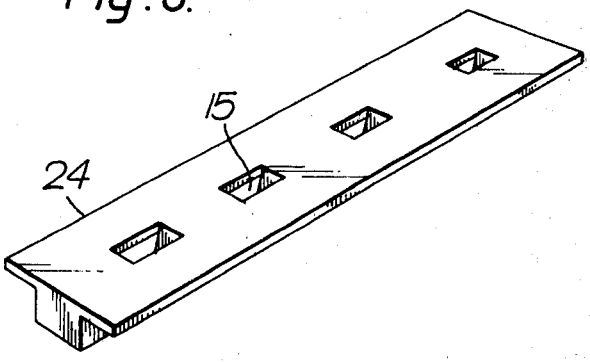
FIG. 6 shows a perspective view of a masking member suitable for use with the apparatus shown in FIG. 5.

Referring now to FIG. 5, in a modified form of the plating tank and track link shown in FIGS. 2 and 4, the track link 2 is formed in two parts, each part comprising a track line 7 which is formed to be slidable on parallel tracks 8 mounted on or constituting the top of the tank 4. One of the track lines 7 is provided with the spring loaded lid 17, pressure pad 18 and roller 19 described hereinabove with reference to FIG. 4. Additional rollers 23 may be provided to facilitate correct alignment of the track lines 7. In addition to increasing the stability of the track link in use, this arrangement enables the handling of components of varying widths, because the spacing between the tracks 8, and thus that between the track lines 7, is adjustable. The seal 16 comprises two elongate members of L-shaped cross section. Thus a continuous slot 15 for plating is provided. Alternatively, a masking member 24, shown in perspective in FIG. 6, may be inserted between the track lines 7 in place of the seal 16. The masking member 24 may be formed of silicone rubber and ceramic material or plastics material, and is formed with plating openings 15 therein. Several masking members of various widths may be provided to enable the handling of strip components of varied widths.

The strip will generally arrive at the selective plating apparatus pretreated, in earlier stations of the same apparatus. p The track links 2 can readily be made by moulding techniques.

We have also invented a new electrolyte (and other solution) stripper for use on strip components. As is well known, flaps on weirs are not very efficient and also air knives are expensive to operate. We have discovered that a slot can be very effective, if the slot is of suitable width (so that the strips pass through with little clearance) but in addition has sloping walls to and/or from the slot itself. Such a device would be used to remove pretreatment solution from strip to be plated in accordance with the present invention.

In the description, each of the features common to the two embodiments of the invention described has been designated by the same numeral throughout.

The apparatus described above may further comprise a second plating tank disposed in a second electroplating zone for carrying out further plating of component which have been selectively plated as described above. In particular, edge portions of a strip component may be plated. For example, a strip component is selectively plated with silver or gold as described above and successive plating heads engaging the strip are then passed through the second plating zone where portions of the strip extending from sides of each plating head are plated with tin, lead or an alloy thereof, the plating head, and in particular the track lines thereof, acting as a mask.

What we claimed is:

1. An apparatus for use in selective plating a component, which apparatus comprises an electroplating zone, a series of movable selective plating heads in an endless chain configuration, wherein each plating head comprises an electrolyte opening, means for indexing the plating head to a component, means for engaging the component so as to expose an area to be selectively plated to electrolyte, means for releasably sealing the rear of the component in the region of the area to be plated, means for fastening the sealing means prior to the entry of the plating head into the electroplating zone and means for releasing the sealing means after the plating head leaves the electroplating zone, resilient or slidable couplings provided between the plating heads and means provided in the electroplating zone for supplying electrolyte to the area to be selectively plated.

2. An apparatus according to claim 1, wherein the plating heads comprise track links having spring hinged lids, with electrolyte openings provided in the track links and pressure pads on the underside of the lid, the lids being biased into the open position.

3. An apparatus according to claim 1 or 2, wherein a plating tank is provided in the electroplating zone and wherein the plating heads comprise track lines which slide on tracks formed by walls of the plating tank.

4. An apparatus according to claim 3, wherein the spacing between two track lines of a plating head, and that between the tracks on which the track lines are slidable, is adjustable.

5. An apparatus according to claim 4, wherein the means for engaging the strip so as to expose, in use, the area to be selectively plated to electrolyte comprises a masking member insertable between the two track lines, and having one or more plating openings formed therein.

6. An apparatus according to claim 3, wherein the plating tank is provided with adjustable weirs, so that the flow of electrolyte to the plating zone can be adjusted in conjunction with the rate of flow of electrolyte into the plating tank.

7. An apparatus according to claims 1 or 2, wherein the means for supplying electrolyte to the area to be selectively plated, and the electrolyte openings, comprise an elongate slot jet, and a corresponding slot formed in a lower part of each plating head and in which the elongate slot jet locates, respectively.

8. A method of selective plating a component, which method comprises: providing an electroplating zone and moving through the electroplating zones a series of movable selective plating heads in an endless chain configuration, each plating head comprising an electrolyte opening, indexing a plating head to the component, engaging the component so as to expose an area to be selective plated, sealing the rear of the component in the region of the area to be plated, prior to the entry of the plating head into the electroplating zone, releasing the rear of the component after the plating head leaves the electroplating zone, providing resilient or slidable couplings between the plating heads and supplying, in the electroplating zone, electrolyte to the area to be selectively plated.

9. A method according to claim 8, wherein the component being plated is a strip of lead frames and wherein the strip is being selectively plated with silver.

10. A method according to claim 9, wherein the lead frames are indexed by means of slots therein.

* * * * *